US005499764A

United States Patent [19]

Carlsson

[11] Patent Number: 5,499,764

[45] Date of Patent: Mar. 19, 1996

[54] PACKAGING UNIT FOR SHEET LIKE MATERIAL

[75] Inventor: Rolf A. Carlsson, Örnsköldsvik, Sweden

[73] Assignee: Mo Och Domsjo Aktiebolag, Ornskoldsvik, Sweden

[21] Appl. No.: 351,276

[22] Filed: Dec. 7, 1994

[30] Foreign Application Priority Data

Jun. 9, 1992 [SE] Sweden ..... 9201748

[51] Int. Cl.[6] ..... B65D 5/468

[52] U.S. Cl. ..... 229/117.16; 229/23 BT; 229/125.19; 229/122

[58] Field of Search ..... 229/23 BT, 122, 229/117.16, 117.22, 125.19

[56] References Cited

U.S. PATENT DOCUMENTS

| | | | |
|---|---|---|---|
| 466,479 | 1/1892 | Winchester | 229/122 |
| 2,135,021 | 11/1938 | Zalkind . | |
| 2,682,362 | 6/1954 | Larson et al. . | |
| 3,015,430 | 1/1962 | Bauer | 229/122 |
| 3,143,275 | 8/1964 | Diggs . | |
| 3,189,245 | 6/1965 | Kistner | 229/122 |
| 3,306,516 | 2/1967 | Taylor, Jr. | 229/117.16 |
| 3,441,193 | 4/1969 | Castle | 229/122 |
| 4,105,152 | 8/1978 | Elward | 229/23 BT |
| 4,317,536 | 3/1982 | Dickerson | 229/23 BT |
| 4,717,070 | 1/1988 | Taub | 229/117.16 |
| 4,964,511 | 10/1990 | Meschi | 229/122 |

FOREIGN PATENT DOCUMENTS

| | | | |
|---|---|---|---|
| 0042711 | 12/1981 | European Pat. Off. . | |
| 0057011 | 8/1982 | European Pat. Off. . | |
| 0412226 | 2/1991 | European Pat. Off. . | |
| 2096393 | 2/1972 | France . | |
| 350943 | 11/1972 | Sweden . | |
| 451705 | 10/1987 | Sweden . | |
| 459915 | 8/1989 | Sweden . | |
| 413033 | 7/1934 | United Kingdom | 229/122 |

*Primary Examiner*—Gary E. Elkins
*Attorney, Agent, or Firm*—Sughrue, Mion, Zinn, Macpeak & Seas

[57] ABSTRACT

A packaging unit for sheet like material such as paper, comprises a box (1) provided with a lid (2), both of rectangular configuration and including a center part, two side parts and two end walls parts which are easily dismountable. Each box end wall part (4) has an additional end wall part (3) which is mounted externally of the first mentioned end wall part (4) and has a generally rectangular configuration and an area which is 70–100% of the actual area of the inwardly lying end wall part (4). The additional end wall part (3) is fastened at least partially to the lower region of the inwardly lying end wall part (4) and the additional end wall part (3) is provided in its upper half with a foldable lip (7) from which material has been removed on at least one side (5,6). The lip (7) enables the uppermost part of the additional end wall part (3) to be folded outwardly of the lid end wall part and subsequent to being folded, functions to strengthen and protect the resultant gripping aperture.

7 Claims, 3 Drawing Sheets

PACKAGING UNIT FOR SHEET LIKE MATERIAL

TECHNICAL FIELD

The invention relates to a packaging unit for all types of sheet like material. The packaging unit is particularly suited for paper, for instance paper which has been collected into bundles or reams. The sheet size of the material, preferably paper, may vary. The packaging unit is suited for packaging standard paper sizes, such as A4 (210×297 mm) and A3 (420×297 mm). Other paper sizes which can be packaged in the packaging unit include U.S. Quarto (215×279 mm) and American Foolscap (215×330 mm), which are typical North American paper sizes.

The packaging unit may be made from any know packaging unit material. A particularly suitable material is corrugated fibreboard. Paperboard or cardboard may also be used to advantage. Within the group corrugated fibreboard a brown coloured fibreboard can be used, i.e. in which all of the material layers are comprised of paper which has been manufactured from unbleached or semi-bleached pulp. From the aspect of appearance and possible printing it is beneficial to produce that side of the fibreboard which is to form the outer surface of the packaging unit from a bleached, preferably fully bleached, pulp, or from a paper which has been given a white colour in some other way.

When the packagaing unit is used for packaging paper or paper bundles of A4-size, the surface weight of the corrugated fibreboard will conveniently lie within the range of 100–200 g/m$^2$.

BACKGROUND ART

Sheet like material, such as paper in bundles and for instance of A4-size, are normally packaged in conventional, rectangular boxes comprising lid which is fitted over the open upper side of the box. Normally, one or more bands, for instance plastic bands, are wrapped around the box and its lid. With regard to copying paper, for instance, they are often bundled into one ream, i.e. 500 sheets are collected and cased in a paper envelope. There are packaging units with different numbers of paper bundles or reams. Five reams is not an unusual number. When the paper in question, for instance copying paper, is to be used the outer packaging unit is opened first, and then the inner package. The outer packaging unit is opened by clipping or cutting the band or bands around said unit and then lifting the lid from the box, so as to provide easy access to the first ream. It is then only necessary to remove the inner packaging material, i.e. the wrapping paper and place the paper bundle in the copying machine. The aforesaid (outer) packaging unit is not free from problem. Firstly, five reams of paper for example, weigh several kilos, and hence the bands wrapped around the unit tend to bite into the hand or hands of the person carrying the packaging unit and therewith cause discomfort. Furthermore, it is only the uppermost reams which can be reached readily in the box of the packaging unit. The reams which lie in the lower region of the box are difficult to reach and if sufficient care is not taken when removing these reams from the box, there is a risk that the hands may be blistered to some slight extent. The user can at least find the last ream of papers difficult to remove. Because of this, several people tipp the box over, so that the ream or reams fall from the box.

Alternative packaging units are found described in the literature and are commercially available. One such packaging unit is described in the European Patent Application 0 412 226. This packaging unit also consists of a box and a lid. The lid, however, includes an outwardly projecting wing portion at each short end of the box, this wing portion including a gripping aperture which will accomodate one hand of the user. When packaging reams of paper, for instance, the reams are stacked on the bottom of the box. The walls of the box are then raised and anchored to one another in their raised positions. The lid provided with said wing portions is then fitted onto the upper part of the box. Prior to transporting the packaging unit, or when the packaging unit is to be handled, the whole unit is turned so that the former lid now forms the bottom of the unit, and the unit can be carried and placed where desired with the aid of the wing portions. When the paper is to be used, the box is lifted up and the reams of paper lie free for the taking.

DISCLOSURE OF THE INVENTION

Technical Problem

The traditional packaging unit for, for instance, paper bundles, i.e. a box with a lid and wrapped with one or more bands, is often found difficult to carry by the user. Neither is the traditional packaging unit satisfactory from the aspect of enabling the paper bundles to be taken easily from the package.

Solution

The present invention provides a solution to the aforesaid technical problem and relates to a packaging unit for sheet like material, such as paper of A4-size, comprising a box provided with a lid, both of which have a rectangular shape and comprise a centre part, two side parts and two end wall parts with the lid being easily dismountable from the box, wherein each of the box end wall parts presents an additional end wall part which is applied on the outside of the first mentioned end wall part of essentially rectangular shape and with an area which is 70–100% of the actual or imaginary area of the inwardly lying end wall part, characterized in that the additional end wall part is at least partially fastened to the lower part of the inwardly lying end wall part; and in that the upper half of the additional end wall part presents a foldable lip from which material has been removed on at least one side thereof and which partly enables the uppermost part of the additional end wall part to be folded out beyond the end wall part of the lid and partly when folded functions to strengthen and protect the resultant gripping aperture.

It is preferred, that the box of the packaging unit is produced from a foldable, continuous blank which in addition to those parts which are included in a conventional rectangular box comprising a bottom and four sides, also presents the two additional end wall parts.

However, it is quite possible to produce the box that forms part of the inventive packaging unit from a conventional, continuous and foldable blank and to fasten the two additional end wall parts to their respective original end wall part of the box in a subsequent, separate operation, said box being of conventional construction up to this stage of manufacture.

Each of the inner end wall parts of the box is preferably divided into two parts of essentially equal size, as will be described and shown later on in the text. However, the end wall part concerned may alternatively consist of a fully covering part. When the inner end wall part is divided into two parts, it is not necessary for the parts to be of mutually the same size and neither need they have an extension such that parts will together cover the whole width of the end wall part of the box. It is, among other things, with this in mind that it was mentioned in the introduction in this part of the description that the inner end wall part may have an imaginary area, i.e. the area is calculated from the height times the width wherein the width is the distance between the two side parts.

According to one preferred embodiment of the invention, the additional end wall part is fastened in a punctiform fashion or a continuous fashion to one portion of the inwardly lying end wall part along at least one horizontal line at the lower part of said end wall part. Any known fastening manner can be used and it is highly suitable to use an adhesive, for instance a melt adhesive. However, there is nothing to prevent, that pins, for instance, are used.

In the case of the aforedescribed preferred embodiment of the invention, it is irrelevant if the fastening line or lines extends, or extend, vertically instead of horizontally and exends/extend from the lower edge of the box to approximately midway of the box height, for instance.

According to the aforesaid embodiment of the invention, after having lifted away the lid, which holds the packaging unit together, it is possible to fold down one long side of the box and therewith expose one long part of the reams, so that the reams can be reached easily by the user.

The packaging unit according to the invention can besides for keeping reams, i.e. 500 sheets of paper cased in a paper envelope, be used for keeping a bundle of, for example 2500, free paper sheets. In view of the circumstance that the paper sheets in such a case are not protected, primarily from damp in the surrounding air, by a wrapping paper it is suitable to provide the packaging unit material with a vapour barrier. That can be done in several ways. If the packaging unit material consists of corrugated fiberboard the inner side of the outer liner can be coated with a layer of polyethylene in an amount of (or in a thickness corressponding to) 10–15 gramme per $m^2$. Also other suitable plastic materials can preferably be used. From a recovery point of view it can be suitable to provide the packaging unit material with a vapour barrier of another type than a plastic layer, for example by coating the packaging unit material with an emulsion of latex and/or a wax.

In the case when free paper sheets in a bundle are kept in the packaging unit of the invention it is not suitable to fold one of the long sides of the box outwardly, i.e. during removal of the paper sheets, but to fold down and outwardly the end wall parts at one end of the box. That is done by firstly breaking the attachment, for example of adhesive, between the inner end wall part and the outer or additional end wall part and after that the outer end wall part of the box is folded down against the ground while the inner end wall part of the box is folded to the side so that the short side of the paper sheets become fully visable and the paper sheets easily accessible.

Although not preferred, it is possible, in accordance with the invention, to fasten the additional end wall part along one or more lines which extend along the lower part of the two parts of the inner end wall part, both horizontally and vertically.

It is advantageous to provide the additional end wall part with at least one groove, of which at least one being formed at the upper part of the additional end wall part to provide flexibility. The groove or grooves can be applied on both the outer surface and the inner surface of the additional end wall part, the latter position being preferred.

When using the invention for packaging paper bundles or reams for instance, the actual packaging process may be effected in either one or two ways.

According to one of the ways, the box blank, made of corrugated fibreboard for instance, is laid flat on a band. Five reams of paper, for instance, are placed on the centre part of the box blank and the box blank is then raised on all four sides of the stack of reams and certain parts of the sides are mutually fastened with the aid of melt adhesive for instance, so as to obtain a more or less intact box. The package is then closed with the aid of a lid which is also produced by raising the sides of a flat lid blank and fastening the sides together. The lid which has a slightly larger extension than the box is fitted down over the open upper part of the box. The uppermost ream will often project slightly above the edge of the box, which means that the upper side of the lid need not necessarily come into contact with and in the vicinity of the edge of the box.

According to the other way both the box and the lid are prefabricated from respective blanks and a bundle of five reams of paper for instance is then placed in the prefabricated box and the box is then fitted with the prefabricated lid, so as to close the package.

The aforedescribed packaging unit can be advantageously transported to any middlemen concerned and finally to the user without further arrangement. However, it is possible to apply, for instance, one or more bands around the packaging unit as an additional precautionary measure, and then preferably transversely around the unit, or to enclose one or more packaging units in a shrink film encapsulation for instance.

When the material in the packaging unit, for instance copying paper, is to be used and carried to the copying apparatus for instance, the user inserts a finger into one of the earlier described apertures (or two fingers, one in each aperture) in the additional end wall part and can thereby fold out the lip present in the end wall part. The upper portion of the additional end wall part is then drawn outwards by gripping said lip with at least two fingers, so that said upper portion will lie outwardly of the end wall part of the lid. This procedure is carried out at both end wall parts of the packaging unit. The lip is then folded upwards so as to connect with the uppermost portion of the additional end wall part and the upper portion of the additional end wall part is folded slightly outwards at the same time, so that the user is able to insert at least the fingers of respective hands into the two resultant apertures in the additional end wall parts. This upward folding of the material results in doubling of the thickness of the material above the resultant aperture, which strengthens the material in the lifting region of the packaging unit. The user is therewith able to lift the packaging unit and place the unit in a suitable place in a comfortable manner. The lid is then removed and the uppermost ream is taken from the packaging unit, whereafter the wrapping paper is removed and the copying paper placed in the copying machine. According to one preferred embodiment of the invention, one long side of the packaging unit can be freely folded out and down, which greatly facilitates removal of the lowermost reams.

Advantages

The inventive packaging unit can be handled easily and smoothly by the ultimate user of the contents of the packaging unit. Although the contents of the packaging unit, for instance five reams of copying paper, are relatively heavy, the user is able to move the packaging unit and its contents through distances both large and small, without being caused discomfort by the material biting into the hands. The packaging unit is easily opened, namely by simply lifting away the lid.

In the case of the preferred embodiment of an inventive packaging unit, in which one long side of the box can be freely folded outwardly, the invention affords the additional advantage of enabling the lowermost reams to be removed comfortably from the packaging unit.

Another advantage afforded by the inventive packaging unit resides in that the packaging unit can be readily returned to its original state after use. When one long side of the box has been folded down, this side is folded back to its original position, after use. The lip of the additional end wall part is also returned to its original position and after pressing the additional end wall parts in towards the inner end wall parts of the box, all that remains is to close the package by placing the lid over the open part of the box.

The inventive packaging unit includes all of these advantages, without needing to turn the unit up and down under any condition.

BEST MODES OF CARRYING OUT THE INVENTION

In the following preferred embodiments of the invention will be described with reference to the drawings and furthermore the invention will be described in more detail particularly with regard to certain parts thereof.

Figure 1:
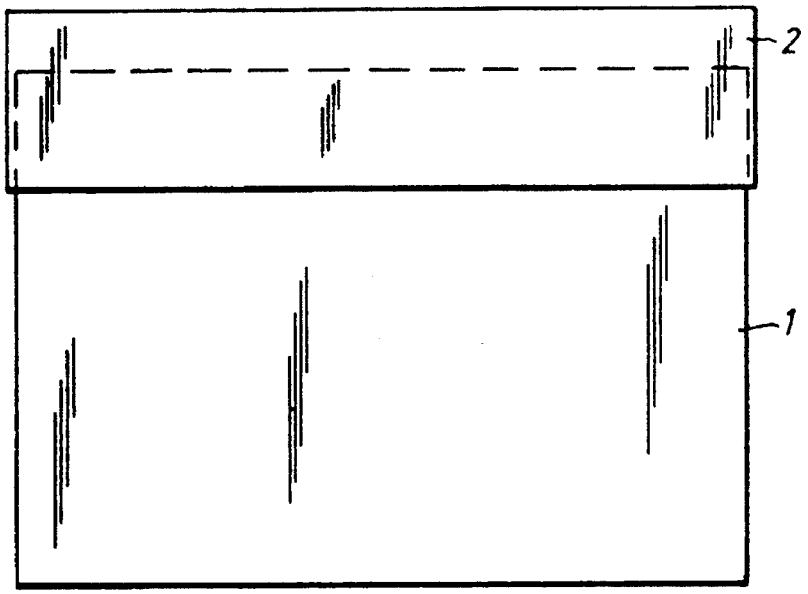
In FIG. 1 an embodiment of the inventive packaging unit is shown, as seen from one long side thereof.

FIG. 1 simply shows that the inventive packaging unit is comprised of a box 1 and a lid 2.

Figure 2:
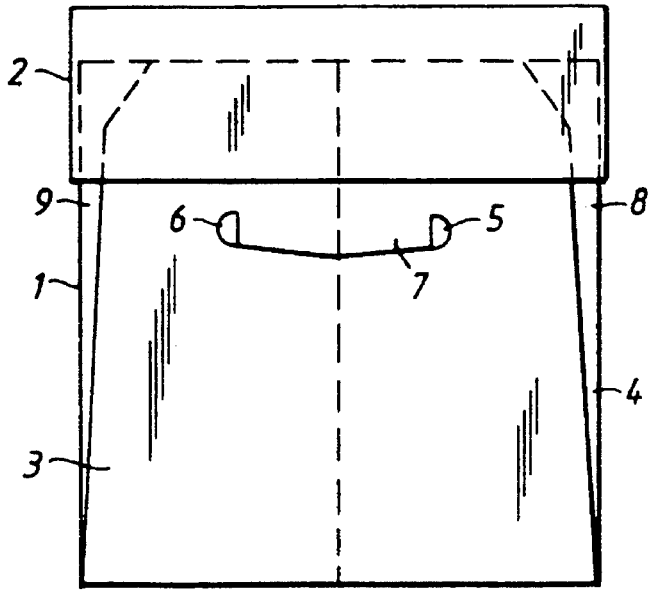
In FIG. 2 an embodiment of the inventive packaging unit is shown, as seen from one end side of the unit.

The special feature of the inventive packaging unit lies in the box and the construction of its end wall parts, as illustrated in FIG. 2. Although this Figure shows only one end wall part of the box, it will be understood that its other end wall part is identical to the one illustrated. The inner end wall part 4 of the illustrated box is comprised of two equal halves 8 and 9. According to the invention, it is not essential for the end wall part 4 to comprise two parts, since it is also possible to use a coherent box end wall part. Furthermore, when the end wall part 4 is comprised of two parts 8 and 9, one part may be broader or narrower than the other. Furthermore, it is possible for the two parts 8 and 9 to leave a gap therebetween and then preferably in the midway section of the box end. On the outside of the inner end wall part 4 of the box 1 an outer end wall part 3 is mounted. This outer end wall part 3 has a generally rectangular configuration and an area which is 70–100% of the actual or imaginary area of the inwardly lying end wall part. In the illustrated case, the box end wall part 3 is slightly conical and slopes from the bottom of the box towards its top. The illustrated slope can vary, of course. That part of the outer box end wall part 3 which is covered by the end wall part of the lid 2 has been shown in broken lines in the drawing. The absolute uppermost part of the outer end wall part 3 has still a more pronounced conicity. The degree of slope may also vary in this case. The aforesaid conicity facilitates drawing of the part of the outer end wall part 3 which is covered by the lid down beneath the lid with the aid of the lip 7 so as to expose said part outside the lid.

Figure 3:
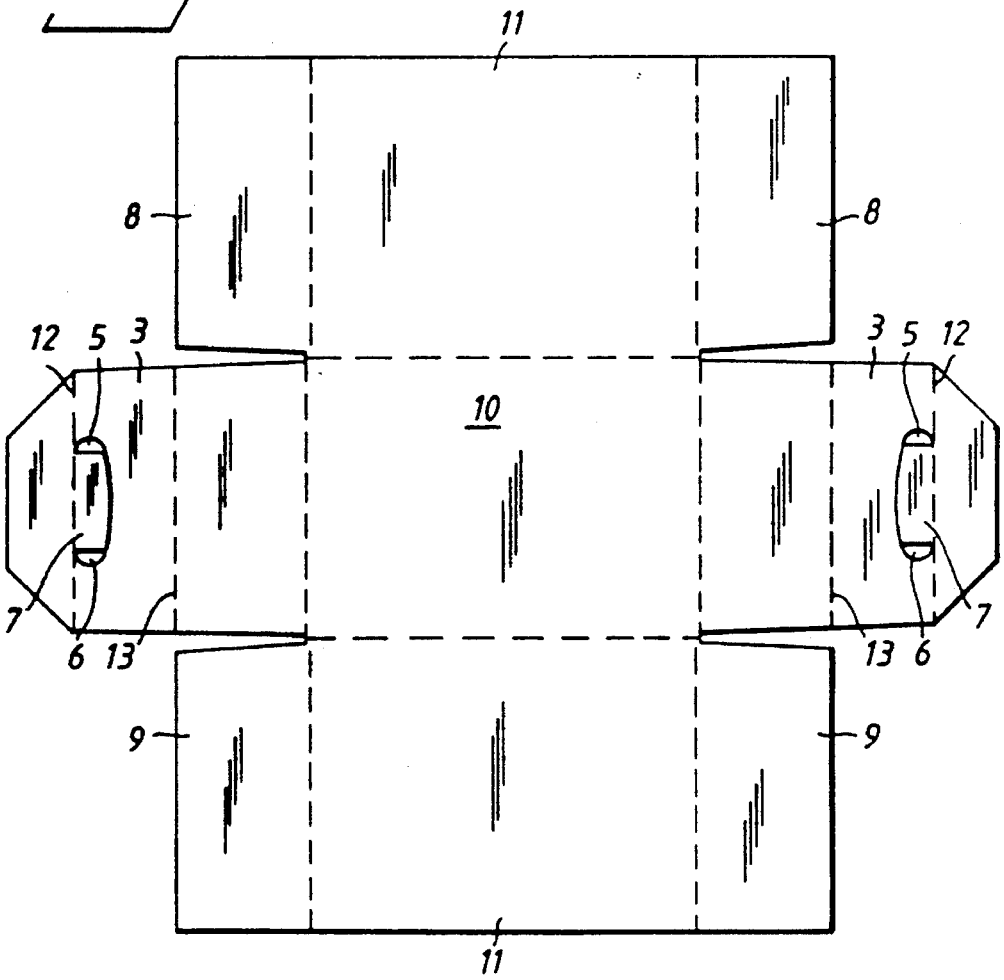
In FIG. 3 the flat blank is shown from which the box in one embodiment of the packaging unit according to the invention is produced.

In FIG. 3 the box blank is illustrated, which after folding and fastening forms the box 1. The box blank is comprised of a centre part or a bottom 10, two side parts 11 and two end wall parts 8 and 9, which form the inner end walls of the box. The additional end wall parts 3 depart from and are an extension of the centre part 10. The lip 7 is surrounded by the two apertures 5 and 6. The additional end wall parts 3 include two grooves 12 and 13 to provide flexibility. Both the centre part 10 and the side parts 11 are surrounded by pronounced score lines (depressions in the material), which facilitate folding of the box components to form the box 1.

Figure 4:
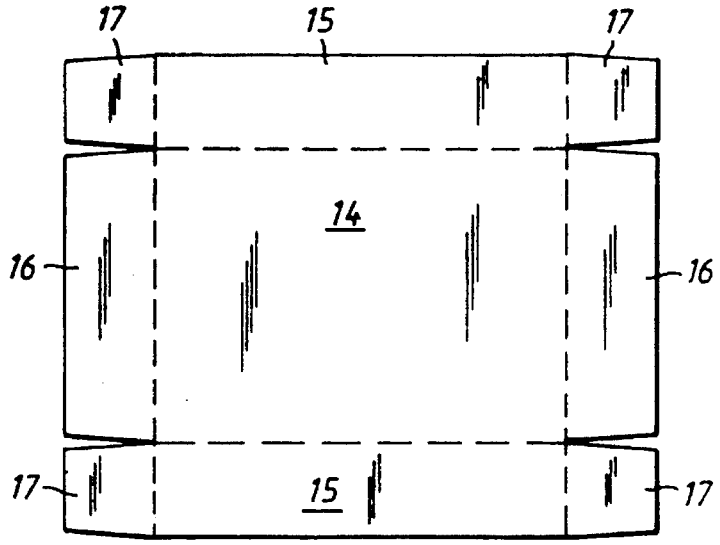
In FIG. 4 the corresponding flat blank for the lid is shown.

In FIG. 4 the blank is illustrated, which subsequent to being folded and fastened forms the lid 2. This blank is also comprised of a centre part 14, two side parts 15 and two end wall parts 16. Each of the side parts has a flap 17 located at each end thereof, said four flaps 17 being of mutually the same size. The centre part 14 and the side parts 15 are also in this case surrounded by pronounced scoring lines (depressions in the material), which facilitate folding of the lid components to form the lid 2. The flaps 17 are first folded up, perpendicularly to the remaining parts of the blank. The side parts 15 are then folded up to an angle of 90°, whereafter the end wall parts 16 are folded up to an angle of 90°. The flaps 17 are then located adjacent the end wall parts 16 at respective corners, and the components are fastened together in the corner regions, in a manner to form a cohent lid structure. The lid components may be fastened in any known manner, for instance may be glued or pinned together.

Figure 5:
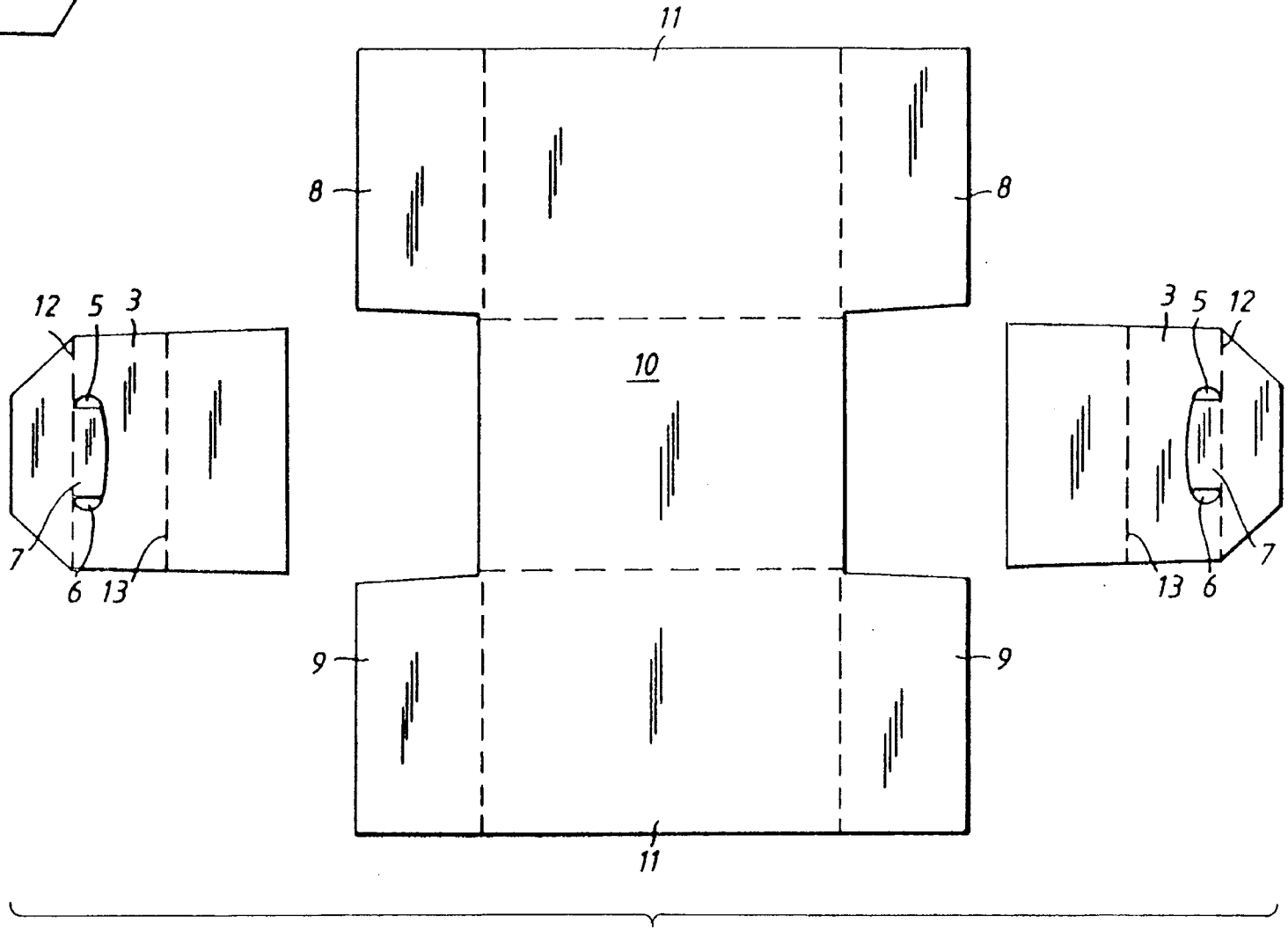
In FIG. 5, flat blanks are shown from which the box in another embodiment is formed.

In FIG. 5, box forming blanks according to another embodiment are shown wherein the same reference numerals as used in FIG. 3 are provided for identifying the same elements. The only difference resides in the fact that the additional end wall parts 3 are separate from the main blank. However, the additional end wall parts are secured to the inner end wall parts 4 in the same manner as in the previous embodiment.

It will be understood that the illustrated exemplifying embodiment of the inventive packaging unit does not restrict the scope of the invention, and that the illustrated embodiment of the inventive packaging unit may be modified in many ways within the scope of the following claims.

I claim:

1. A package unit for sheet like material comprising a box (1) provided with a lid (2), both of rectangular configuration and comprising a centre part, two side parts and two end wall parts and being easily dismountable, wherein each box end wall part (4) has an additional end wall part (3) which is mounted externally on the end wall part (4) and which has a generally rectangular configuration and an area which is 70–100% of the actual or imaginary area of the inwardly lying end wall part (4), characterized in that the additional end wall part (3) is fastened at least partially to a lower region of the inwardly lying end wall part (4); and in that the additional end wall part (3) is provided in an upper half of the additional end wall part with a foldable lip (7) from which material has been removed on at least one side (5, 6), said lip (7) partly enabling an uppermost part of the additional end wall part (3) to be folded outwardly of the lid end wall part and partly, subsequent to being folded, functioning to strengthen and protect the resultant gripping aperture.

2. A packaging unit according to claim 1, characterized in that the box (1) is originally comprised of a continuous, foldable blank which includes the two additional end wall parts (3).

3. A packaging unit according to claim 1, characterized in that the box (1) is originally comprised of a conventional continuous and foldable blank; and in that a separate, additional end wall part (3) is mounted on a respective box end wall part (4).

4. A packaging unit according to claim 1, characterized in that each box end wall part (4) is comprised of two parts of mutually equal size.

5. A packaging unit according to claim 1, characterized in that the additional end wall part (3) is fastened to the lower region of the inwardly lying end wall part (4) along at least one horizontal line on the end wall part.

6. A packaging unit according to claim 1, characterized in that the additional end wall part (3) is fastened to the lower region of the inwardly lying end wall part (4) along at least one vertical line on the end wall part.

7. A packaging unit according to claim 1, characterized in that the additional end wall part (3) is provided with at least one groove on an inner surface of the additional end wall part in an upper region of the additional end wall part.

* * * * *